US005588306A

United States Patent [19]

Schmidt

[11] Patent Number: 5,588,306

[45] Date of Patent: Dec. 31, 1996

[54] PROCESS FOR OBTAINING AN ETHANE-RICH FRACTION FOR REFILLING AN ETHANE-CONTAINING REFRIGERANT CIRCUIT OF A PROCESS FOR LIQUEFACTION OF A HYDROCARBON-RICH FRACTION

[75] Inventor: Hans Schmidt, Wolfratshausen, Germany

[73] Assignee: Linde Aktiengesellschaft, Germany

[21] Appl. No.: 556,191

[22] Filed: Nov. 9, 1995

[30] Foreign Application Priority Data

Nov. 11, 1994 [DE] Germany ..... 44 40 407.7

[51] Int. Cl.[6] ..... F25J 3/00

[52] U.S. Cl. ..... 62/614; 62/623

[58] Field of Search ..... 62/623, 614

[56] References Cited

U.S. PATENT DOCUMENTS 3,524,897 8/1970 Kniel ..... 62/623

3,721,099 3/1973 Forg et al. ..... 62/623

4,229,195 10/1980 Förg ..... 62/23

4,230,469 10/1980 Grimm et al. ..... 62/623

*Primary Examiner*—Ronald C. Capossela

*Attorney, Agent, or Firm*—Millen, White, Zelano, & Branigan, P.C.

[57] ABSTRACT

An ethane-rich fraction for refilling the refrigerant circuit, using an ethane-containing refrigerant in a process for liquefaction of a hydrocarbon-rich fraction, is obtained by removing a partial flow of liquefied hydrocarbon-rich fraction and supplying same to a $C_1/C_2/C_{3+}$ separation column. Roughly in the middle of this $C_1/C_2/C_{3+}$ separation column, an ethane-rich fraction is withdrawn and, optionally after intermediate storage in a buffer tank, is added to the ethane-containing refrigerant.

17 Claims, 1 Drawing Sheet

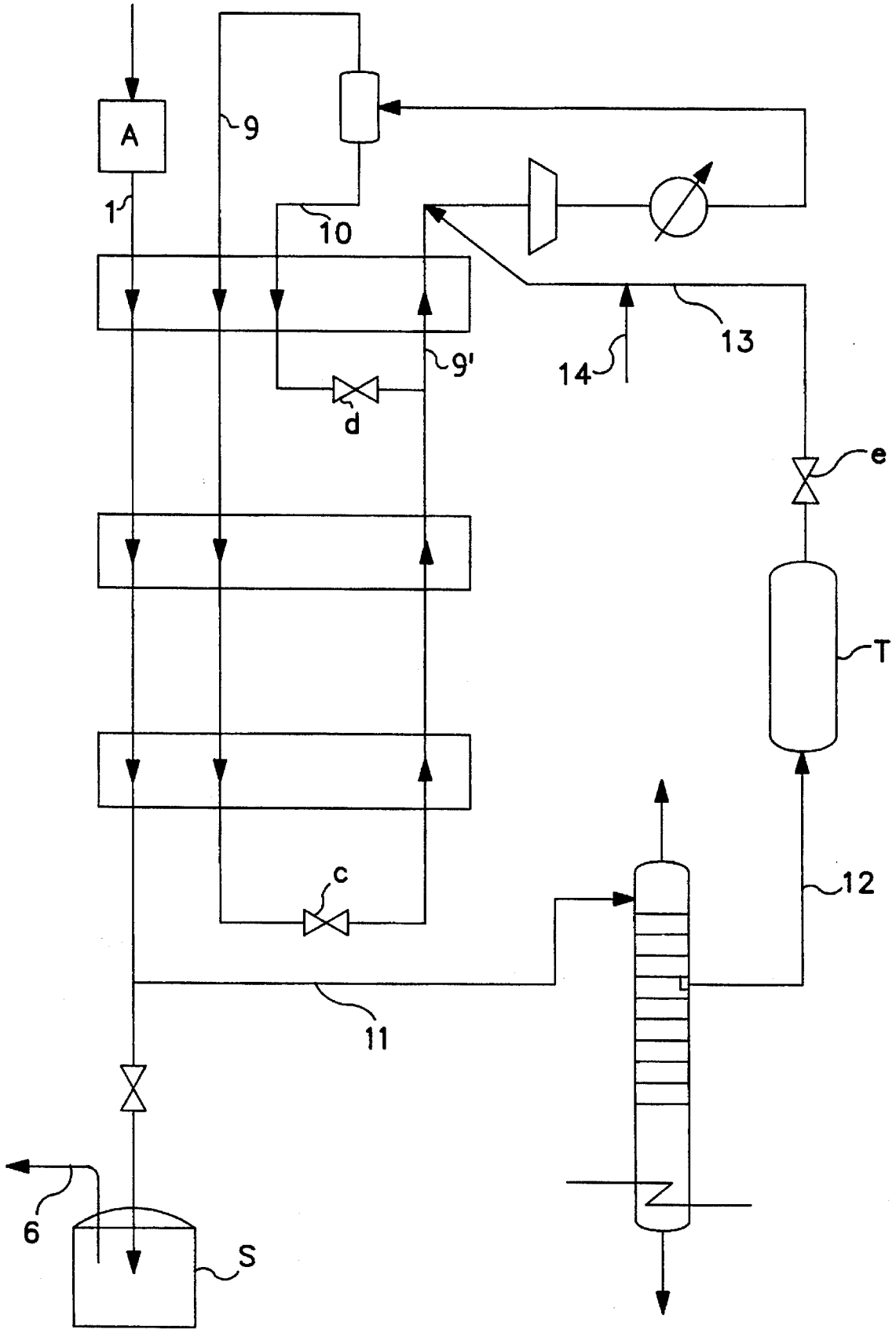
A
9
1
10
13
14
9'
d
e
T
c
12
11
6
S

PROCESS FOR OBTAINING AN ETHANE-RICH FRACTION FOR REFILLING AN ETHANE-CONTAINING REFRIGERANT CIRCUIT OF A PROCESS FOR LIQUEFACTION OF A HYDROCARBON-RICH FRACTION

SUMMARY OF THE INVENTION

The invention relates to a process for obtaining an ethane-rich fraction for refilling the refrigerant circuit of a process for liquefaction of a hydrocarbon-rich fraction. The hydrocarbon-rich fraction is cooled and liquefied by heat exchange against an ethane-containing refrigerant circulated in the refrigerant circuit.

Refrigerant circuits using ethane-containing refrigerants are often employed in processes in which hydrocarbon-rich fractions, for example, natural gas, are liquefied. See, for example, DE-OS 28 20 212 (see also U.S. Pat. No. 4,229, 195).

As a result of losses within these refrigerant circuits, the components forming the refrigerant mixture need to be replenished. In the case of ethane, the component is either supplied from a compressed gas tank or is recovered from the hydrocarbon-rich fraction to be liquefied itself. Since this hydrocarbon-rich fraction, especially in the case of natural gas, contains not only methane and nitrogen, but also heavier components, here especially the $C_{3+}$ hydrocarbons, separation usually involves two separation columns, each having condensers and reboilers. In this case, first the lighter components, therefore the $C_1$ hydrocarbons, are separated. Then, an ethane-rich fraction is withdrawn from via the top of the second separation column, while a $C_{3+}$ hydrocarbon-rich fraction is formed at the bottom of the second separation column.

An objective of the invention is to provide a process for obtaining an ethane-rich fraction with which, compared to the aforementioned alternatives, ethane or an ethane-rich fraction can be obtained more cheaply.

Upon further study of the specification and appended claims, further objects and advantages of this invention will become apparent to those skilled in the art.

These objects are achieved according to the invention by delivering a partial flow of already liquefied hydrocarbon-rich fraction to a $C_1/C_2/C_{3+}$ separation column, withdrawing an ethane-rich fraction roughly from the middle of the $C_1/C_2/C_{3+}$ separation column, and adding the ethane-rich fraction, optionally after intermediate storage in a buffer tank, to the ethane-containing refrigerant.

The process according to the invention represents a simple and effective process for obtaining an ethane-rich fraction which generally can be discontinuously run. In plants of conventional size, this means that the amount of ethane-rich fraction which is obtained within a time interval of 1 to 3 days covers the ethane requirement of the refrigerant circuit for several weeks. The ethane-rich fraction withdrawn from the $C_1/C_2/C_{3+}$ separation column—hereafter called simply the separation column—is generally intermediately stored for a time in a buffer tank and, depending on demand, added to the ethane-containing refrigerant in the required amount. The partial flow which is delivered to the separation column is preferably removed from the main flow of hydrocarbon-rich fraction at a point at which the hydrocarbon-rich fraction is already completely condensed.

One embodiment of the process according to the invention is characterized in that the partial flow of liquefied hydrocarbon-rich fraction is expanded before it is sent to the separation column.

Expanding the partial flow before it is sent to the separation column produces a two-phase mixture at the feed inlet to the separation column. This reduces the energy requirement for separation within the separation column.

According to another embodiment of the process according to the invention the partial flow amount is roughly 5 to 10 vol. % of the total amount of hydrocarbon-rich fraction. In conventional plants for liquefaction of hydrocarbon-rich fractions, removal of this amount is enough to cover the amount of ethane required within the refrigerant circuit. If necessary, the separation column can of course also be designed to handle larger or smaller amounts.

The ethane-rich fraction removed from the center of the separation column has an ethane content between 90 and 99 mole %. The other components present within this fraction, such as, for example, $C_1$ and $C_3$ hydrocarbons, etc., do not have a disruptive effect on the refrigerant circuit to which the ethane-rich fraction is added.

Another embodiment of the process according to the invention is characterized in that the separation column is a sieve-plate column or a column containing packing.

Since overly high requirements are not imposed on the ethane-rich fraction withdrawn from the separation column with respect to ethane purity, this separation column is structurally comparatively simple. In the bottom of the separation column the ethane vaporizes. As the reboiler an electrical heating rod or immersion boiler can be used which can form the bottom of the separation column as a solid flange. The $C_1$ hydrocarbon fraction withdrawn at the head of the separation column as well as the $C_{3+}$ hydrocarbon fraction which is withdrawn at the bottom of the separation column are either discharged at the plant boundary or if possible added to other process flows.

The process in accordance with the invention can be used in conjunction with a variety of processes for liquefaction of a hydrocarbon-rich fraction. See, e.g., U.S. Pat. No. 4,229, 195 and copending applications Serial Nos. 08/556,195, 08/556,196 and 08/556,192.

The ethane-containing refrigerant can contain, for example, components such as $N_2$, $C_1$, $C_2$, $C_3$, $iC_4$, $nC_4$ and $C_5$. The $C_2$-content is preferably about 20–40 vol. %.

BRIEF DESCRIPTION OF THE DRAWING

Various other objects, features and attendant advantages of the present invention will be more fully appreciated as the same becomes better understood when considered in conjunction with the accompanying drawing wherein:

FIG. 1 illustrates an embodiment of the invention.

DETAILED DESCRIPTION

A natural gas feedstream 1 is pre-purified in adsorption zone A by removal of, e,g., $CO_2$ and/or $H_2O$, and then cooled and liquefied. A portion of subcooled liquefied natural gas is fed to the $C_1/C_2/C_{3+}$-separation column (temperature of the column between −140° and −80° C., pressure of the column between 5 and 40 bar) via conduit 11. The remainder of the subcooled liquefied natural gas stream is delivered to storage tank S from which liquefied natural as can be removed via line 6.

This liquefied natural gas feed contains, e.g., 1.0% $N_2$, 96.7% $C_1$, 1.8% $C_2$, 0.5% $C_{3+}$ and 50 ppm(v) $CO_2$ ("%" always stands for "mole %"). The typical $C_2$ range is between 1.0 and 10.0%. The feed temperature is −126° C. and the pressure 40 bar. This feed is expanded, e.g., by an expansion valve, to 12 bar before entering the column. Via conduit 12 a liquid side product is withdrawn containing 1.5% $C_1$, 97.4% $C_2$ and 1.1% $C_{3+}$ with a temperature of −30° C.

This liquid is stored in the buffer tank T and utilized as make-up stream. From the buffer tank T (pressure ~12 bar), the liquid can be fed to the refrigerant cycle (conduits 9, 9' and 10) via conduit 13. As the pressure within the refrigerant cycle is about 4 to 5 bar, an expansion valve e is included. Other make-up streams, e.g., $N_2$ $C_{4+}$, can be fed to the refrigerant cycle via conduit 14.

The top product of the column contains 1.1% $N_2$, 98.8% $C_1$ and 0.1% $C_{2+}$ and leaves the column with a temperature of −121° C. It can be, e.g., used as fuel gas.

The bottom product of the column contains 67.3% $C_2$ and 32.7% $C_{3+}$ and leaves the column with a temperature of −17° C.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

In the foregoing, all temperatures are set forth uncorrected in degrees Celsius and unless otherwise indicated, all parts and percentages are by weight.

The entire disclosure of all applications, patents and publications, cited above, and of corresponding German application P 44 40 407.7, filed Nov. 11, 1994, are hereby incorporated by reference.

The preceding can be repeated with similar success by substituting the generically or specifically described reactants and/or operating conditions of this invention for those used therein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for obtaining an ethane-rich fraction and refilling a refrigerant circuit for liquefaction of a hydrocarbon-rich fraction, said process comprising:

cooling and liquefying a hydrocarbon-rich fraction by heat exchange against an ethane-containing refrigerant circulated in a refrigerant circuit;

removing a partial stream of liquefied hydrocarbon-rich fraction and supplying said partial stream to a $C_1/C_2/C_{3+}$ separation column;

withdrawing an ethane-rich fraction from said $C_1/C_2/C_{3+}$ separation column; and optionally after intermediate storage in a buffer tank, introducing said ethane-rich fraction to said refrigerant circuit.

2. A process according to claim 1, wherein said ethane-rich fraction is withdrawn from the middle of said $C_1/C_2/C_{3+}$ separation column.

3. A process according to claim 1, wherein said partial stream of liquefied hydrocarbon-rich fraction is expanded before introduction into said $C_1/C_2/C_{3+}$ separation column.

4. A process according to claim 2, wherein said partial stream of liquefied hydrocarbon-rich fraction is expanded before introduction into said $C_1/C_2/C_{3+}$ separation column.

5. A process according to claim 1, wherein 5–10% of said hydrocarbon-rich fraction is withdrawn as said partial stream.

6. A process according to claim 3, wherein 5–10% of said hydrocarbon-rich fraction is withdrawn as said partial stream.

7. A process according to claim 4, wherein 5–10% of said hydrocarbon-rich fraction is withdrawn as said partial stream.

8. A process according to claim 1, wherein said ethane-rich fraction contains 90–99 mole % ethane.

9. A process according to claim 3, wherein said ethane-rich fraction contains 90–99 mole % ethane.

10. A process according to claim 4, wherein said ethane-rich fraction contains 90–99 mole % ethane.

11. A process according to claim 5, wherein said ethane-rich fraction contains 90–99 mole % ethane.

12. A process according to claim 1, wherein said $C_1/C_2/C_{3+}$ separation column is a packed column.

13. A process according to claim 1, wherein said $C_1/C_2/C_{3+}$ separation column is a sieve-plate column.

14. A process according to claim 1, whereto said partial stream of liquefied hydrocarbon-rich fraction is removed from said hydrocarbon-rich fraction at a point where said hydrocarbon-rich fraction is completely condensed.

15. A process according to claim 1, wherein the $C_2$ content of said ethane-containing refrigerant is 20–40 vol. %.

16. A process according to claim 1, wherein said partial stream of liquefied hydrocarbon-rich fraction is fed to said $C_1/C_2/C_{3+}$ separation column at a temperature of −140° to −180° C. and the pressure of said $C_1/C_2/C_{3+}$ separation column is 5–40 bar.

17. A process according to claim 1, wherein the pressure within said refrigerant circuit is 4–5 bar.

* * * * *